US006910437B2

(12) United States Patent
O'Reilly et al.

(10) Patent No.: US 6,910,437 B2
(45) Date of Patent: Jun. 28, 2005

(54) WAKEBOARD TOWING SYSTEM

(76) Inventors: Mike R. O'Reilly, 454 Brannan St., San Francisco, CA (US) 94107; Gregory W. Pronko, 458 Brannan St., San Francisco, CA (US) 94107

( * ) Notice: Subject to any disclaimer, the term of this patent is extended or adjusted under 35 U.S.C. 154(b) by 0 days.

(21) Appl. No.: 10/371,615

(22) Filed: Feb. 19, 2003

(65) Prior Publication Data

US 2004/0159278 A1 Aug. 19, 2004

(51) Int. Cl.[7] ..... B63B 21/04
(52) U.S. Cl. ..... 114/253
(58) Field of Search ..... 114/253, 343, 114/364, 242; 441/68, 70; 280/447

(56) References Cited

U.S. PATENT DOCUMENTS 2,974,625 A * 3/1961 Lang ..... 114/253
4,213,413 A * 7/1980 Courtney ..... 114/253
5,943,977 A * 8/1999 Womack et al. ..... 114/242
6,073,953 A * 6/2000 Kendall ..... 280/447
6,374,762 B1 4/2002 Larson et al.
2004/0025774 A1 * 2/2004 Berthiaume et al. ..... 114/253

OTHER PUBLICATIONS

Wake Boarding® Magazine, 2003 Buyers Guide (Feb. 2003, pp 104–105).
Schmidt, Kyle, "Dialing in Your Line Length" Wakeboardingmag.com, WBM.Jun. 2002, pp. 95–96.

* cited by examiner

*Primary Examiner*—Ed Swinehart
(74) *Attorney, Agent, or Firm*—Frank P. Becking

(57) ABSTRACT

A towing system, especially useful in wake boarding is described. Using a beam mounted to a tower and a carriage that travels over the beam, a towline attached to the carriage of one variation of the system offers a rider more air time and eliminates certain burdens created with the towline/rope. Further, more room to gain speed and set up for the wake jump, more air and natural feeling during the air time due to the elimination of rope tightening otherwise experienced. A number of other possible system variations and options in addition to the basic beam and carriage configuration are also disclosed. Preferably, the beam and carriage are configured to offer a virtual pivot point for the tow rope that is pushed forward of where the beam is mounted.

9 Claims, 3 Drawing Sheets

WAKEBOARD TOWING SYSTEM

FIELD OF THE INVENTION

The present invention relates generally to towing of a water sport participant by a vessel, and more particularly to enhancing the performance of a person engaged in the sport of wake boarding. Still further, is may be used for engaging in other water sport activities including wakeskating (i.e., a sport employing a small wakeboard without bindings), water-skiing (e.g., trick skiing, barefoot skiing, and slalom skiing), wake surfing and air chair, kneeboard and inflatable riding.

BACKGROUND

Water sport recreation involving a tow vessel had previously been focused on one and two ski water skiing. Recently, a sport known as wakeboarding has overtaken water skiing in popularity. As in the former sport, in the latter a rider is towed behind a power boat. However, the rider planes over the water upon a board (with or without foot holds). In either case, advancing riders engage in aerial maneuvers "tricks". Most often, these involve launching off one side of the wake created by the draft of the boat. The other side of the wake is sometimes, often preferably used as a landing ramp.

As the sport of wakeboarding has advanced, there has been an ever-increasing need for the tow boat to create a larger wake to ride and/or propel aerial maneuvers. A larger wake allows for higher aerials and longer hang time to pull more complex tricks. Such activity is further aided by anchoring the towline at a high elevation above the boat deck. The higher towline anchor point modifies the point of rotation of the line in the vertical direction. At lower elevations, the angle the line makes relative to the water provides some upward component of force; at higher elevations, the downward pull otherwise experience by the line is negated or at least reduced as compared to when a lower anchor point is used. An exemplary towing tower providing higher tow line attachment is described in U.S. Pat. No. 6,374,762. Others may be seen in use on any lake or other suitable body of water or in any of a number of industry publications, including Wake Boarding® magazine.

Another advantage offered in using a tower relative to a stem mounted tow attachment point is in that the attachment point is moved forward. Such tie-in placement helps avoid the rider being pulled in a direction different from that in which the boat is traveling (as occurs when the stem of a boat swings around during a turn). Were it not for interference issues with the passenger/pilot compartment of the boat, is would be preferred to push the point even further forward toward (and even possibly beyond) the bow of the boat. In this way, the rider will always be pulled in the direction the boat is pointing. However, such an arrangement is not feasible with existing tower designs.

The present invention addresses this issue. Still further, the invention provides a manner in which to increase the side-to-side range of the tow rope without lengthening the same. The value of doing so stems from an issue unique to wakeboarding. Namely, employing a relatively shorter rope allows a rider to enjoy the greater height of the wake near the boat. However, the shorter rope decreases the hang time available to a rider who is subject to the rope's pull in a tighter arc. Careful rope length adjustment is typically undertaken to balance these factors. Instead, the present invention offers a system with lesser need to compromise.

The invention does so by employing a rail in association with a towing tower, and a carriage adapted to travel across the rail or beam. While U.S. Pat. No. 4,213,413 shows a stem-mounted rail/slider arrangement and other rope/slider arrangements are known for use in water skiing, these are not configured as in the present invention. More particularly, the system in the '413 patent employs a semicircular rail that results in an effective pivot point at or within its boundaries (as if the rope(s) had a pivot substantially at the rear rail of the boat). Such a configuration is utilized in order to provide clearance from an outboard motor and provide improved boat stability.

In the present invention, however, the rail is configured to provide a forward-located virtual rope pivot as noted. This feat is attained without physically setting the pivot in that location—a task believed either to be impossible, impracticable or unfeasible in view of present boat configuration. In an associated manner, the forward-located virtual pivot point provides additional lateral freedom allowing longer hang time and potential range of motion as is advantageous, particularly in wakeboarding. Therefore, the present invention is distinguished over the referenced systems not only in function, but also by virtue of the different issues presented between water skiing and wakeboarding. It is these very differences that have contributed so greatly to the meteoric rise in the popularity of wakeboarding.

SUMMARY OF THE INVENTION

As alluded to above, the present invention concerns a rail structure for mounting to a typical wake boarding tower or another relatively raise structure mounted to a power boat for towing a wakeboarder. The rail is configured in the form of a shallow arcuate path or straight rod. In this manner, a carriage configured to roll or slide across the length of the structure causes a rope attached thereto to behave as if it were pivoting about a location forward of the rail attachment points.

Numerous configurations are possible for the rail, tower and carriage. Actually, a track, belt or another structure configured to follow the shape of the rail may be provided in place of carriage. In any case, a tow line attachment or location that travels as described is provided.

One aspect of the invention requires that the system emulates a rope attachment point located at least some distance in front of limits of such travel. The point (R or R') is preferably pushed about 6 ft forward of the actual rope attachment point to the carriage, slide, track, etc., anywhere to infinity (the condition approximated by a flat rail). To facilitate this, the rail preferably has a radius of curvature greater than half the typical beam (width) of a modern towing boat (i.e,. greater than about 6 ft), preferably more than about 12 ft, more preferably about 15 ft, most preferably about 18 ft, though it may vary substantially. Relative to the boat, the pivot point that the system emulates (i.e., the "simulated" or "virtual" pivot point) is preferably within 10 ft., at or in front of the bow.

Generally, it will be preferred to maximize the width of the beam or rail employed in the invention. This provides the system and a rider more lateral freedom before transitioning from a state in which the carriage is traversing the beam to pivoting around the terminal point(s) of the carriage. In some instances, it will be preferred to extend the beam or rail beyond the support structure of the tower. In such instances, for a typical power boat as may be used, beam widths allowing for carriage travel between about 8 and about 10 ft. may be preferred, yet wider runs up to 12 or even 15 ft or more may be employed. Still further, shorter carriage travel paths less than 8 ft may be employed and still offer significant utility.

However configured, it is important that the tower and beam/rail be placed so that the latter is at or near the center of the boat. Especially when considering longer beams, the leverage offered when the rider reaches the limit of travel and sets an edge into the water for turning would make it nearly impossible to continue following a straight line with any substantial forward or rearward placement of the same pace. Driving in a straight line is particularly important in wakeboarding for the purpose maintaining a clean wake.

In some instances it may be desired to provide mechanical options to limit the travel of the carriage relative to the available span of the beam or rail. By thus configuring the system, it is possible to use the setup to provide one or more adjustable pivot point(s) for the towline. In fact, a single pivot point can be set by locking the carriage at any point across the beam to create a static pivot location on one side of the boat or the other (e.g., for positioning riders straight in front of one side of the wake or another). Multiple static pivot locations can be set in this manner as well. As may already be appreciated, any such limitation to carriage travel may be to the center of the beam or off-center. Various limiting means such as collars, pins, clips, clamps, tie-offs, etc., may be employed in this regard.

Other features of the invention may include, but are not limited to, fabricating the system so the rail arc is set at a desired angle or making it adjustable so as to be selectably set at any of a variety of angles. For example, the beam can be angled in an upward arc (like a rainbow) to more closely track a rider's aerial path. Such adjustment may be facilitated via a screw, automatic means (e.g., including hydraulics) or simply be manually set. In any case, calibration markings, such as the number of degrees relative to a reference, may be provided.

What is more, where an arcuate rail is provided, it may have a varying curvature. While a substantially constant radius member may be employed, parabolic-shaped arcs or other forms may be desired—even if the virtual pivot point at the apex of the curve is not pushed forward as described above (i.e., it may exhibit a "reverse" curvature by comparison—for at least some portion of the beam). In a similar vein, it may sometimes be desired that the beam be configured to include some combination of straight and curved sections, whereas the curves may have a different radius. It is important, however, that the carriage smoothly transition from any such section to another.

Still further, it may be desired to design the present system so to allow flex or "give" in one or more planes or directions. Such options as may be provided by way of material selection and/or suspension means such as shocks or shocks and dampeners. Such features may be utilized to enhance user performance, reduce stress or fatigue and/or reduce wear to the water craft or beam-supporting structures.

Likewise, various force-assist features may be provided in the system. For example, springs (elastomer, air or coil-based) to store and release energy or one or more active mechanisms (such as an pneumatic or hydraulic cylinder) may be provided at the limits of carriage travel. Other approaches may alternatively, or additionally, be employed. In any case, reasons for storing and releasing energy possibly include helping to accelerate the carriage across the beam or to accelerate the angle of the beam up and down as discussed above. Conversely, the use of springs and energy storage could be used to absorb impact for both the carriage and/or beam movement.

Still further, features to control travel speed of the carriage across the beam may be provided. In this respect, controls may be provided to adjust or moderate the speed in which the carriage or beam move via a friction brake, clutch, etc. These features may be useful in order to aid in keeping the carriage from beating the participant across the wake. Still further, they can add or offer resistance as necessary to perform certain maneuvers.

The invention includes such hardware as described as well as the associated methodology of using the same. It is further contemplated that the rail and carriage may be originally provided in connection with a tower (either as part of an aftermarket product or originally with a water craft), or as an add-on unit. In instances where the beam is to be attached to existing boat towing devices (towers), any means such as quick release collars, clamps, straps, buckles, slides, pins/sockets, etc. may be employed. Generally, any such system will be provided in such a manner so as to minimize the time and effort of instillation on a particular boat and to maximize the number of structures to which the inventive sub-system may be fit.

While these and other options may be employed in the present invention, it is to be understood that any one or combination of such features as described above may be provided and thus, ultimately, be claimed as the present invention. Accordingly, certain variations of the invention may possess some advantages and others different ones.

BRIEF DESCRIPTION OF THE DRAWINGS

Each of the figures diagrammatically illustrates aspects of the invention. To facilitate understanding, the same reference numerals have been used (where practical) to designate similar elements that are common to the figures.

DEFINITIONS

Figure 1:
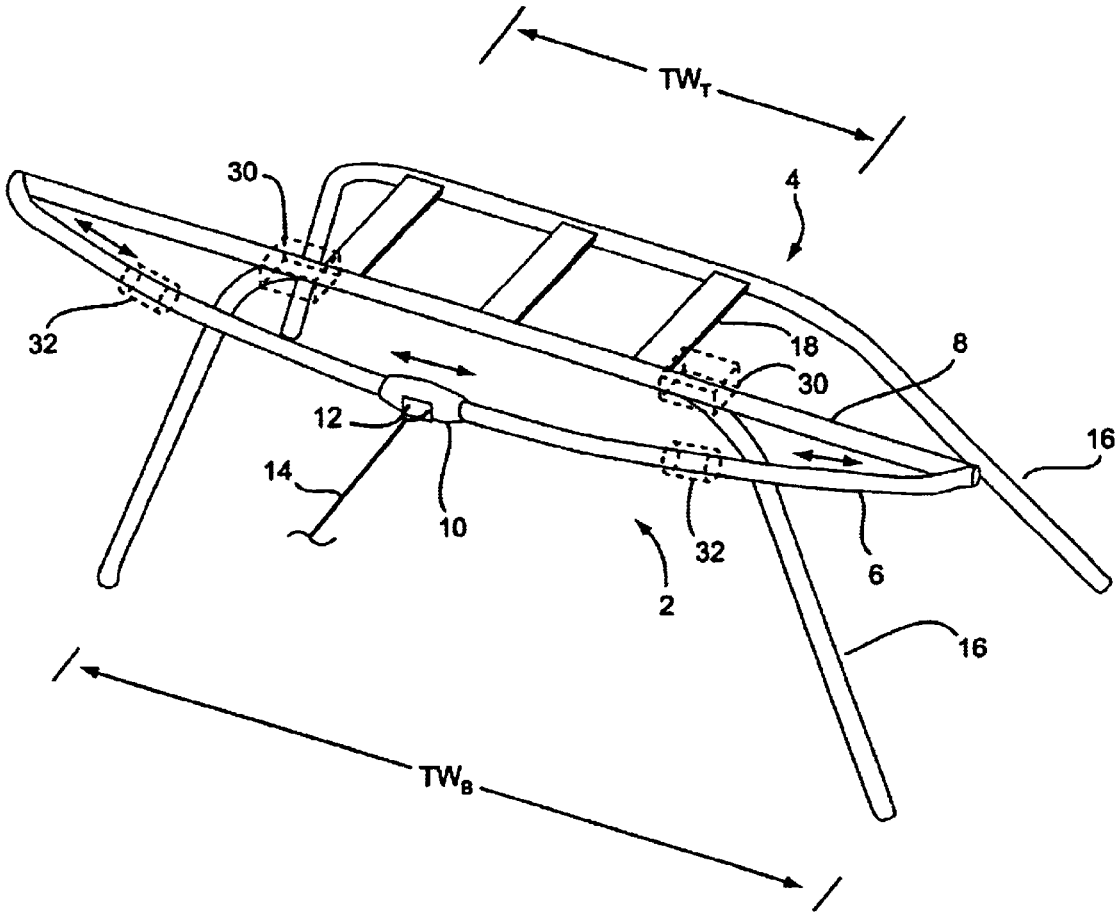
FIG. 1 is a perspective view of a variation the invention where a beam with carriage is mounted to a tower.

Unless defined otherwise, all technical and scientific terms used herein have the same meaning as commonly understood by one of ordinary skill in the art to which this invention belongs. Still, certain elements are defined below for the sake of clarity and ease of reference.

By carriage, it is meant is a member adapted to traverse another structure. Exemplary carriages include simple loops, pulleys, trolleys, slides, blocks, sleeves, etc.

By beam or rail, it is meant is a body over which the carriage travels. The beam may have any of a variety of cross sections including round, square, rectangular, etc. tubing or rod. Alternatively, I-beam, T-beam, C-channel and other cross sections may be employed. Still further, the beam or rail may be slotted, perforate or imperforate/solid or otherwise provided. The beam may be monolithic or have a multi-piece construction. It may be such that one or more portions are extendable or telescoping to provide increased reach.

By tower, it is meant is any of a variety of standard or custom elevated structures currently or as may in the future be employed for towing a rider in the sport of wakeboarding as referenced above and known in the art. Exemplary structures are presented in the Wake Boarding® magazine's 2003 Buyers Guide (February 2003 issue, pages 104 and 105) incorporated herein by reference.

DETAILED DESCRIPTION

Before a variation of the present invention is described in detail, it is to he understood that this invention is not limited to particular embodiment set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein, especially those mentioned in the Summary of the Invention and Definition sections above and such further details as may be drawn from the abstract hereto.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "and," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs.

Turning now to FIG. 1, one variation of the invention is disclosed. It includes carriage system 2 and tower support structure 4. The carriage system provides a means for tow rope attachment and traversal across said tow tower. In FIG. 1, elements of the overall system are provided integrally by welding a carriage travel beam 6 to an extension beam 8 of the tower. As shown, each of the travel and extension beam are wider that the top of the tower as indicated by "$WT_T$" and may be wider than the base of the tower at "$TW_B$". This provides for greater travel of carriage 10 across beam 6 as indicated by arrows.

The travel of carriage is shown limited only by the juncture of the two beams. Yet, as discussed above other stop features are contemplated.

Carriage 10 is preferably configured to include a bearing system of any of various types. In the least complicated version, the carriage may comprise a lubricious plastic material in thereby serve without the need for internal bushings, other plane bearings, roller bearings, etc.

The carriage may take any of a variety of forms. That shown is in the form of a sleeve surrounding beam 6. To facilitate placement on the later component, the sleeve may be a two-piece item or otherwise constructed. In any case, the carriage shown includes a loop 12 for fastening a towline 14 thereto. A clip, knot or other sort of attachment (not shown) may be provided between the elements.

Figure 2:
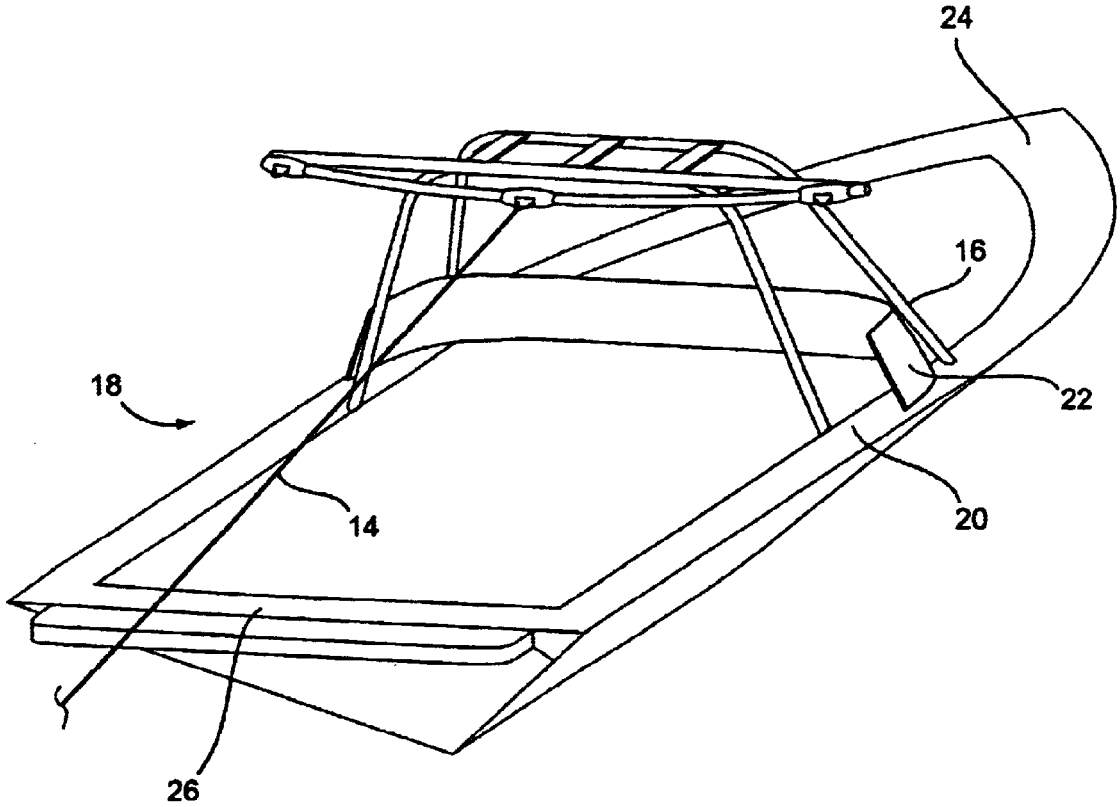
FIG. 2 is a perspective view of the variation of the invention of FIG. 1, attached to a power boat.

The tower shown, includes four legs 16. Yet other configurations are feasible. The legs derive from "U" shaped forms joined by spanners 18. While alternate configurations are possible, the tower show (except for its provision for carriage system 2) is otherwise standard. FIG. 2 shows the manner in which such a structure is mounted to a boat 20. Legs 16 attach to the sides or gunwales 20 of the boat.

In order to substantially center the tower with the boat, two legs are affixed in front of the boat's windshield 22, toward the bow 24 of the boat. Towline 14 is shown passing over the stern 26 of the boat 18.

Figure 3:
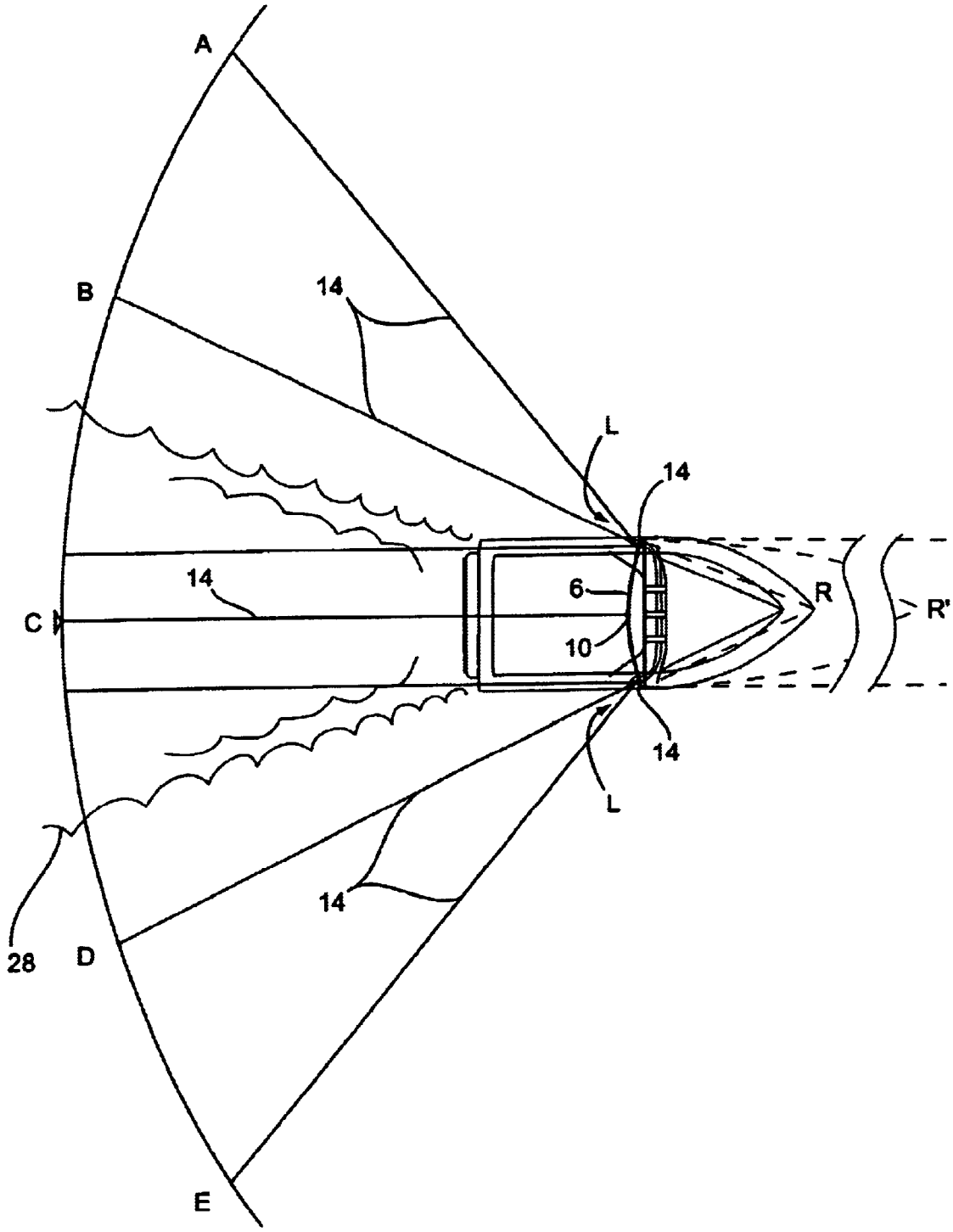
FIG. 3 illustrates the manner in which a tow line and the beam carriage behaves according to the present invention, in connection with the variation of the invention shown in FIGS. 1 and 2.

While FIG. 2 shows a static orientation of the inventive system, including a power boat and a towline as it might pull a wakeboarder located directly behind the boat, FIG. 3 shows the full range of the inventive apparatus 2. In use, a rider will travel between locations A–D relative to the boat. In the central location "C" carriage 10 will generally be located at the center of beam 6. When traveling across the wake 28 behind the boat, the carriage is intended to traverse over the beam toward its extremes. The action of the carriage is to follow pull of the rope until limits "L" are reached.

Beam stiffness is imperative to its functionality. As the sport has been advancing the technical maneuvers have brought about the need for stiffer tow ropes that will not stretch (spectra fiber, carbon weave etc.). This allows for a dramatic increase in responsive feel from the boat to the rider that eliminates the "return" of ropes that stretch under load and cause problems as they return back to their original length. A rope type of device such as the one from the 50's would cancel all of these advances in two ways.

Metal (e.g., stainless steel, aluminum alloy), plastic or composite materiel (e.g., carbon fiber, Kevlar, fiberglass, combinations of the same, etc.) may be employed in construction of beam 6 and/or tower 4. Generally, material will be selected in view of strength, weigh and relative cost considerations. Depending on the material chosen, welding, boding or various other attachment approaches may be employed for assembly as within the discretion of engineers and artisans.

Recall, that while a discrete carriage member is shown, it also to be understood that one or more towline attachment points according to the invention may be provided otherwise. For example, a system is contemplated where such an attachment is provided that it will follow a desired beam contour by means of an attachment to a belt on rollers. Still further, cables or chains on sheaves, a track/gear assembly or another system meeting the functional characteristics referenced herein may be employed. What is of primary importance is the attachment point and the travel dictated by the system—whether with a carriage or another sort of assembly. Still, a carriage substantially as shown may be preferred for its simplicity in construction and cost-effectiveness.

Yet another variation of the invention that is contemplated is in providing the beam and carriage apparatus in such a manner as they may be retrofit to any wakeboard tower. One manner of accomplishing this end is by providing attachment mechanism(s) between a beam and tower, for example, as indicated by the dashed boxes 30 in FIG. 1. Any of a variety of clamping structures or means may be employed for such purposes. In this or another manner, the beam will be adapted to be removably mounted to a wakeboarding tow tower.

Another variation of the invention that is contemplates is one in which the system includes one or more stops or limiting members as indicated by the dashed cylinders 32 in FIG. 1. Wherever they are placed, such means (e.g., as mentioned in the Summary of the Invention above) can be used to setup one or more static pivot points, to limit or modify carriage travel and/or facilitate the use of multiple carriages (e.g., where each is able to run across half of the beam).

Though the invention has been described in reference to certain examples optionally incorporating various features and depicted in reference to a single example, the invention is not to be limited as such. Numerous modifications and/or additions to or adaptations of the above-described embodiments may be apparent to one skilled in the art; it is intended that the scope of the present inventions extend to all such modifications and/or additions. The breadth of the present invention is to be limited only by the literal or equitable scope of the following claims.

That being said, We claim:

1. A tow apparatus, comprising:

a carriage, a tow tower, and a beam, wherein said carriage is adapted to traverse said beam and be attached to a towline, and wherein said beam is flat or has a radius of curvature greater than about 6 ft in a section over which said carriage can traverse, and wherein said beam includes ends that extend laterally beyond a width of said tower.

2. The apparatus of claim 1, further comprising a power boat, wherein a simulated pivot for a towline attached to said carriage is within about 10 ft of a bow of said boat.

3. A The apparatus of claim 1, wherein said beam is adapted to be removably mounted to a wakeboarding tow tower.

4. The apparatus of claim 1, wherein said carriage comprises a towline mount.

5. The apparatus of claim 1, wherein said carriage includes a bearing system selected form a pulley, roller bearings, and plane bearings.

6. The apparatus of claim 1, wherein said carriage has a range of travel over said beam of between about 8 and about 15 ft.

7. The apparatus of claim 1, wherein radius of curvature is between about 6 ft and about 18 ft.

8. The apparatus of claim 1, wherein at least one stop is provided at a location along said beam inside of connection points of said beam to any supporting structure.

9. A tow apparatus, comprising:

a carriage, and a beam, wherein said carriage is adapted to traverse said beam and be attached to a towline, and wherein said beam is flat or has a radius of curvature greater than about 6 ft in a section over which said carriage traverses, and wherein at least one stop is provided at a location along said beam inside of any connection points of said beam to supporting structure.

* * * * *